United States Patent [19]

Dunicz

[11] 4,205,710

[45] Jun. 3, 1980

[54] FUNNEL DEVICE FOR SAFE DISPOSAL OF CHEMICAL WASTES

[76] Inventor: Boleslaw L. Dunicz, 8 Locksley Ave., #1H, San Francisco, Calif. 94122

[21] Appl. No.: 906,061

[22] Filed: May 15, 1978

Related U.S. Application Data

[63] Continuation-in-part of Ser. No. 763,530, Jan. 28, 1977, which is a continuation-in-part of Ser. No. 625,309, Oct. 23, 1975, abandoned, which is a continuation-in-part of Ser. No. 484,107, Jun. 28, 1974, abandoned.

[51] Int. Cl.[2] ..... B65B 1/06; E03C 1/26

[52] U.S. Cl. ..... 141/9; 141/297; 141/331; 4/206; 4/286; 210/163; 210/304; 210/456; 141/286

[58] Field of Search ..... 141/297, 298, 299, 300, 141/199, 331, 9, 98, 340; 210/474, 482, 479, 163, 304, 456; 4/286–292, 295, 206; 422/99, 101

[56] References Cited

U.S. PATENT DOCUMENTS

| | | | |
|---|---|---|---|
| 201,472 | 3/1878 | Williams | 210/482 |
| 243,002 | 6/1881 | Stevens | 4/286 |
| 299,513 | 6/1884 | Bolton | 141/340 |
| 593,834 | 11/1897 | Chambers | 210/482 |
| 760,069 | 5/1904 | Hunter | 141/297 |
| 1,903,366 | 4/1933 | Mercier | 4/292 |
| 3,116,751 | 1/1964 | Hamilton | 4/206 |
| 3,289,218 | 12/1966 | Mehilos | 4/206 |
| 3,334,574 | 8/1967 | Douglas | 210/455 |

*Primary Examiner*—Hiram H. Bernstein
*Attorney, Agent, or Firm*—Harry A. Pacini

[57] ABSTRACT

A device for safe disposal of chemical wastes for placement in a sink atop the drain for the simultaneous mixing of disposable flowable material and flushing liquid, such as tap water, into the sink drain. The device consists of a funneling means in cooperation with a supporting sleeve essentially a cylindrical strainer attached to a beveled horizontal flange which extends inward beyond the supporting sleeve in close proximity of the funneling means to form an annular opening there between. The flange supports the funnel device over the sink drain.

4 Claims, 4 Drawing Figures

FUNNEL DEVICE FOR SAFE DISPOSAL OF CHEMICAL WASTES

This application is a continuation-in-part of copending application Ser. No. 763,530, filed Jan. 28, 1977, which in turn is a continuation-in-part of now abandoned application Ser. No. 625,309, filed Oct. 23, 1975, which in turn was a continuation-in-part of now abandoned application Ser. No. 484,107, filed June 28, 1974.

BACKGROUND OF THE INVENTION

In many chemical laboratories found in scientific, educational, industrial, medical and other research facilities, flowable materials such as liquids, but not limited to liquids, must frequently be disposed of through a sink. Many of these liquids exhibit undesirable characteristics, such as volatility, where the formation of the vapor phase of a substance may be dangerous to living things. Additionally, the corrosive nature of some liquids makes their rapid discarding important to avoid biological and non-biological damage to the immediate area. The most general method of discarding any liquids has been to pour them into a sink and, subsequently, to flush them with tap water or the like into the sink drain.

Experience has shown that the prevalent method for disposing of liquids can be frequently hazardous. For instance, a liquid may backsplash from the sink floor, and, if corrosive, may inflict injury to persons handling it or cause damage to objects in the vicinity. Likewise, it is obvious that volatile liquids allowed to spread over large surface area of the sink evaporate from it at a high rate into the surroundings before their draining is accomplished. The occupants of the premise are then exposed to an annoyance or a health hazard, depending on the properties of the liquid vapors. In the case of a liquid being both volatile and corrosive, the above undesirable characteristics are compounded.

Persons discarding liquids encounter frequently yet another hazard when the sink contains accumulated solids such as pieces of papers, corks, broken glass and solid chemicals. Such solids accumulate on and in the strainer and interfere with draining of the discarded liquids. Persons who attempt to free strainers of those materials and do not observe proper caution may get fingertips cut with fragments of broken glass lodged in the strainer, suffer chemical burns or stains, and the like.

The prior art discloses funnels for transfer or filtering of liquids, but it does not deal with safe disposal of liquids through a sink drain. Likewise, the prior art discloses sink strainers, but not of the kind encountered in the present invention that would allow unrestricted passage of flushing liquid into the sink drain while prohibiting the sink drain or strainer itself from becoming clogged with solid material.

More significantly, the prior art does not teach or disclose means for protecting plastic gaskets found at the orifice of the drainpipe for the sink. Because of the presence of such plastic gaskets, they are vulnerable to attack by leaching by organic solvents.

Even more significant, the prior art does not teach or disclose the advantage of the Venturi-suction effect caused by the aspirator-effect produced on the flowing material down the funnel. the aspirator-effect of the present invention is created in conjunction with the strainer and flange in cooperation with the funnel to be explained more fully hereinafter.

For example, Hunter U.S. Pat. No. 760,069, relates to a funnel having vent holes in a collar at the junction of the spout and body of the funnel. There is no means for forming a Venturi-suction or aspirator-effect on the flowable material poured into the funnel.

Further, Bolton U.S. Pat. No. 299,513, relates to a funnel with a sustaining sleeve extending down from the body of the funnel and preferably extending a short distance below the lower end of the funnel's eduction nose. Bolton does not suggest nor anticipate a flange or other means to provide for a Venturi-suction or aspirator-effect on the flowable material poured into the funnel.

Additionally, Patterson U.S. Pat. No. 3,377,634, relates to a drain basket which clearly is not a funnel. Further, even though the basket has side openings and drainage openings in the bottom of the basket, no suggestion is seen to lead to the funnel device of the present invention.

Stevens, U.S. Pat. No. 243,002, relates to a device for thawing out sink spouts. There is no teaching of a flange cooperating with the funnel in close proximity thereto to form a Venturi-suction or aspirator-effect on the flowable material introduced into the funnel.

Mercier et al., U.S. Pat. No. 1,903,366, relates to a detachable sink strainer. There is no funnel associated with the sink strainer nor is there a teaching of a flange for creating a Venturi-suction or aspirator-effect on the flowable material introduced into the funnel.

Williams, U.S. Pat. No. 201,472, relates to an improved funnel for filling opaque vessels. The funnel is constructed with two nozzles, one concentric to the other and longer such that an air space is formed between the nozzles. Provision is made for a cup-shaped strainer which is dropped into the nozzle of the funnel. No provision is made nor teaching given of a flange in close cooperation with the funnel to form the Venturi-suction or aspirator-effect on the flowable material passed through the funnel.

Further, there is not adequate teaching in any reference cited hereinabove taken alone or in any combination one with another to make obvious or anticipate the present invention.

SUMMARY OF THE INVENTION

Applicant has invented a funnel device for the safe and convenient disposal of a flowable material, such as a liquid, but not limited to a liquid, into a sink drain while simultaneously using a flushing liquid, such as tap water or the like within the sink.

The device of the present invention provides a funneling means with an eduction nose to conduct the flowable material being discarded. A sleeve member as a cylindrical strainer having an upper rim and lower rim, supports the funneling means and eduction nose on the upper rim sand sleeve member, and extends downward from the funnel member terminating in a flat beveled horizontally oriented flange on the lower rim, which extends inward in close proximity to the funnel and outward from the strainer. A plurality of openings in the strainer permits passage of tap water and the like, and the strainer at the same time prohibits solid materials that may be present in the sink from otherwise clogging the drain over which the funnel device is placed. This is particularly favored by the substantially vertical orientation of the strainer with respect to the flange and sink bottom. The flange serves as a collecting tray for solids retained by the strainer. Solid material which accumulates on the flange can be easily discarded by lifting the device from the sink and shaking or scraping said solid material into a waste disposal container.

The protrusion of the eduction nose within the drain prevents the exposure of gaskets, at the sink bottom and drainpipe junction, to destructive leaching agents. Fins may be incorporated into the funneling means to prevent vortex formation, and hence to maximize the flow rate of any liquid being discarded. A removable trap in the form of a short tube having side vents can be affixed to the end of the eduction nose for retrieval of objects accidentally dropped into the funnel.

The structural arrangement of the parts of the funnel device of the present invention allows for exertion of a suction or aspirator effect by means of a Venturi-effect on the waste material poured into the funnel device. Said Venturi-effect occurs, for example, when tap water is run simultaneously through the strainer into the sink drain. In passing through the chamber created by the strainer and inner flange, the Venturi-effect is generated. This suction alleviates the disposal of the waste material as well as it reduces substantially the spread of vapors above the sink and funnel device.

Accordingly, it is an object of the present invention to minimize the rate of volatilization of a liquid being discarded since the surface area of a volume of a liquid confined to funneling means is many times smaller than that of the same volume of the liquid allowed to spread over a sink floor.

A further object of the invention is to provide a device allowing for safe discarding of a flowable material such as a liquid by mixing it with flushing liquid such as tap water in a common sink drain. The device also strains any solids that may enter the drain while allowing for the free passage of the flushing liquid.

Yet another object of the invention is to obviate the possibility of backsplash by employing a funnel with a slanted interior surface.

A further object of the invention is to allow stacking of one device on top of another, and so on, such that the uppermost device will be more accessible for pouring off of the waste liquid from bulky containers.

A further object of the invention is to provide an easily cleaned strainer for solid materials often accumulated in laboratory sinks.

A further object of the invention is to preclude leaching of plastic sink gaskets by organic liquids.

A further object of the invention is to provide a removable trap which can be affixed to the eduction nose of the device for retrieval of objects accidentally dropped into the funneling means.

Additional objects and advantages of the invention, especially with regard to particular features and characteristics thereof, will become apparent from the following specification.

DESCRIPTION OF THE INVENTION

Figure 1:
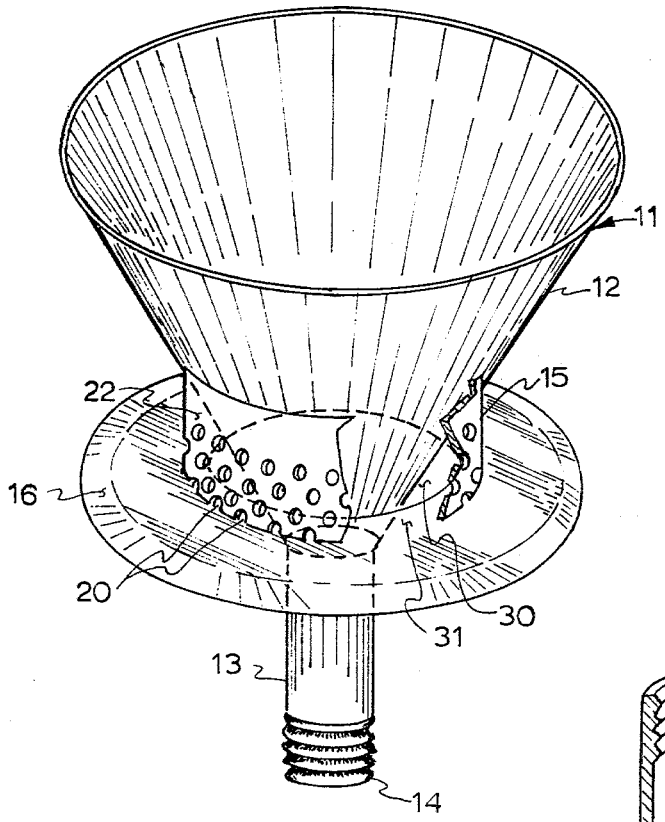
FIG. 1 is a perspective view of the funnel device operatively placed over a sink drain.

With reference to the accompanying drawings, the device is generally indicated as 11. In FIG. 1, the device 11 is shown as comprising a funneling member such as a conical segment 12 connected to an eduction nose 13 through which the flowable material or liquid to be discarded passes exiting from the end of the eduction nose 14. The end of the eduction nose 14 may be threaded to accommodate a trapping means, FIG. 4. A cylindrical strainer 15 having an upper rim and lower rim is concentrically disposed around the conical section 12 and securely fastened thereto at the upper rim of the strainer. The cylindrical strainer 15 extends downward and terminates in a beveled horizontal flange 16 on the lower rim which preferably extends inwardly from the strainer 15 to a close proximity of the conical segment 12 thereby forming an inner flange 31. The strainer 15 is preferably securely affixed to the conical segment 12. The beveled flange 16 is a flat horizontally oriented flange which extends outwardly beyond the strainer 15 as well as inwardly to a close proximity of the conical segment to form the inner flange 31. The flange 16 is preferably securely attached to the cylindrical strainer 15. The cylindrical strainer 15 is progressively spaced from the conical segment 12 between the junction with the conical segment 12 and the flange 16 so as to form a chamber 22. A plurality of openings or holes 20 in the strainer 15 allows for the rapid passage of flushing liquid, such as tap water, into the common drain 18.

Figure 2:
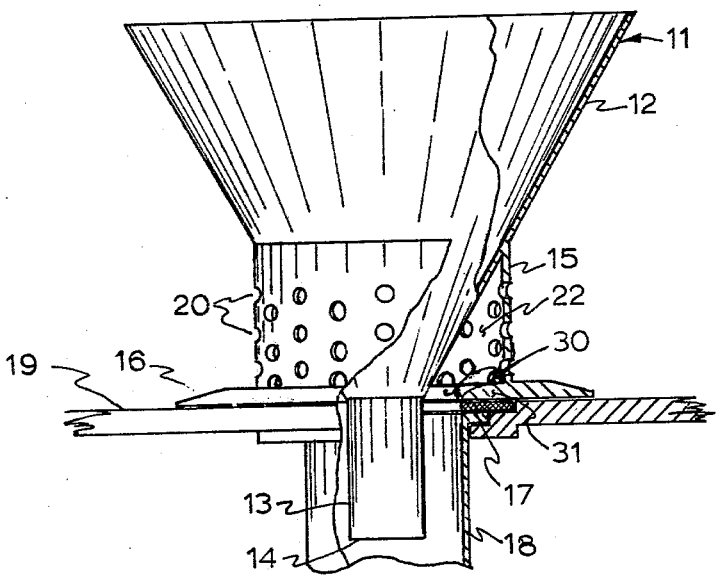
FIG. 2 is a vertical sectional of the funnel device operatively placed over a sink drain.
Figure 3:
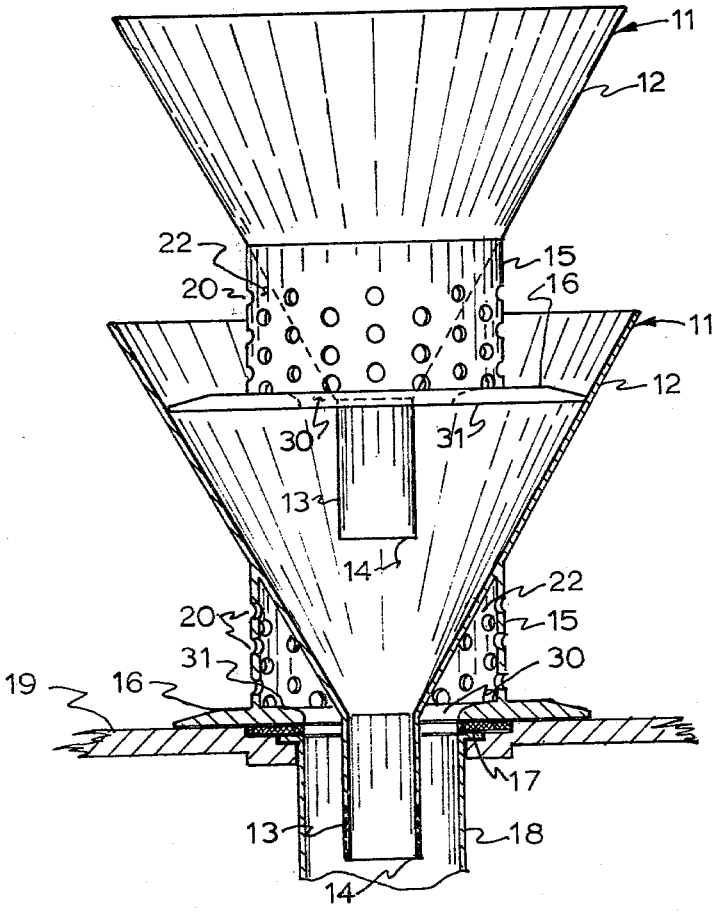
FIG. 3 is a vertical sectional view of two funnel devices in stacked conformation operatively placed over a sink drain.

With reference to FIGS. 1–3, the device 11 is shown operatively placed on the sink bottom 19 over the common drain 18. Shown is the drain gasket 17, which is protected from solvents introduced into the drain 18 by means of the device 11. The eduction nose 13 protrudes into the common drain 18, while the horizontal beveled flange 16 rests on the sink bottom 19 which incorporates the drain gasket 17. The flange 16 acts as a collecting tray for solids which accumulate in the sink and are blocked or strained by the strainer 15.

FIG. 3 depicts the situation wherein one device 11 is stacked upon another device for use of both in cooperation, when waste liquids are discarded from containers too bulky for the manipulation of the containers within the space offered by the sink.

FIGS. 1–3 illustrate the significant arrangement of the inner flange 31 in close proximity to the conical segment 12 in the formation of the chamber 22. Incorporated therein is the inner flange 31 annularly disposed around the conical segment 12. Said inner flange 31 is of slightly greater cross-sectional area dimension than the conical segment 12 at the point of close proximity so as to define an annular opening 30 between said inner flange 31 and said conical segment 12. The strainer openings 20 permit flushing liquid, as tap water, to flow through the annular opening 30 from the chamber 22. The flushing liquid flows circumferentially around the conical segment 12 and downwardly toward the eduction nose 13 into the common drain 18. By an aspirator-effect, also known as a Venturi-effect, from the resulting pressure drop to aspirate the entering fluid or flowable material, the pressure drop is induced by the force of the flow of flushing liquid, flowable material introduced into the funnel is drawn down into the drain. Steam, splattering vapors and the like are inhibited and minimized from rising and contacting the outer areas around the device or the operator. Therefore, by employing the process herein described the hazards produced in the disposal of certain flowable materials can be effectively controlled or eliminated and all safety hazards and operating difficulties substantially eliminated.

In operation, the device provides a method of flushing and disposing of a waste flowable material. The device 11 is placed in a sink bottom 19 over the top of a common drain 18. The eduction nose 13 fits within the drain 18 and horizontal flange 16 covers the drain gasket 17. The flushing liquid, such as tap water, runs from the sink through the strainer 15 and the chamber 22 and through the annular opening 30 into the common drain 18. Simultaneously, the waste flowable material is poured into the conical segment 12 and through the eduction nose 14 where the waste material joins and mixes with the flushing liquid and together they enter the common drain 18. The strainer 15 attached to flange 16 retains any solid debris flushed toward the drain by the flushing liquid. Preferably the eduction nose 13 extends a relatively short distance into the drain 18, such that a strong Venturi-effect on the discarded waste liquid will be created as the tap water passes through the strainer openings 20 and down into the common drain 18.

By the operation of the device and placement over a common drain 18, waste liquid is prevented from spreading over the sink bottom 19 as well as causing any damage to the drain gasket 17 by leaching. Moreover, a desirable advantage of the present invention is the safe disposal of waste flowable material by the flushing liquid leaving chamber 22 cascading from the inner flange 31 through the annular opening 30 down against the outside wall of the eduction nose 13 giving rise to desirable suction, by means of a Venturi-effect on the waste material at the terminus of the eduction nose.

Figure 4:
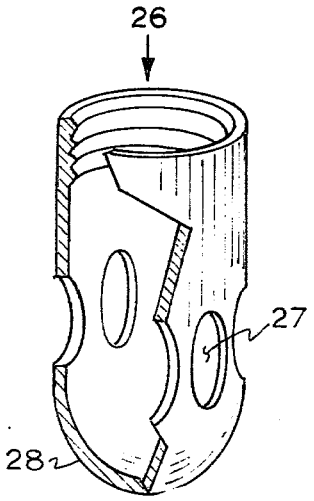
FIG. 4 is a sectional view of a removable trap which can be affixed to the eduction nose of FIG. 1.

Optionally, provision is made for a removable means for trapping solid material accidentally introduced into the funnel device, FIG. 4. Said removable means for trapping solid material in the funnel device has oval shaped side vents 27 suitably sized to allow for unobstructed flow of waste liquid into the common drain. In order to be removable, the means for trapping solid material is adapted as with a threaded opening. The trap has a solid bottom 28 optionally rounded. The means for trapping 26 can be integrally formed on the eduction nose, but preferably the trapping means is removable for stacking purposes of the device as shown in FIG. 3.

The sleeve 15 and funnel 12 may be separate but are preferably formed as one piece and they may be made of any suitable material, for example, metal or a plastic, such as polyethylene.

While in the foregoing specification the embodiments of the invention have been set forth in considerable detail for the purpose of making a complete disclosure thereof, it will be apparent to those skilled in the art that numerous changes may be made in such details without departing from the spirit and principles of the invention.

I claim:

1. A device useful in the safe disposal of waste flowable materials into a drain, said device comprising:

(a) a funnel means having an upper conical segment into which waste flowable material is poured and an eduction nose attached to the lower portion of the conical segment, said eduction nose adapted to extend into a sink drain;

(b) a cylindrical strainer having an upper rim and lower rim concentrically disposed around said conical segment, said strainer extending downward and terminating in a beveled horizontal flange, said strainer having a plurality of holes therein of sufficient area to permit a high rate of inflow of flushing liquid;

(c) said horizontally oriented beveled flange joined to the lower rim of the cylinderical strainer, said flange extending outwardly beyond the lower rim of the strainer to make a seal with the sink bottom and inwardly from the lower rim of the strainer to a close proximity of the lower portion of the conical segment or upper portion of the eduction nose and concentrically positioned there around so as to form a slightly greater cross-sectional area than the conical segment so as to form an annular opening between said conical segment and said inwardly extending flange, so constructed that sufficient flushing liquid flows through said strainer and said annular opening to produce a Venturi-effect on flowable material simultaneously poured into said conical segment.

2. The device of claim 1 wherein a removable means for trapping solid material is affixed to the end of said eduction nose.

3. The device of claim 1 wherein two funnel devices are placed in stacked conformation to cooperate with each other.

4. A method of flushing and safely disposing of waste flowable material comprising (1) placing a device as described in claim 1 over a sink drain with the eduction nose within the sink drain; (2) pouring the waste flowable material into the upper conical segment; (3) simultaneously flushing liquid through the strainer and through the annular opening into the common drain, thereby producing an asperator-effect from the resulting pressure drop induced by the flushing liquid and resulting in a dilution and mixing of the flushing liquid and waste flowable material, and (4) flushing of the flowable material down the sink drain.

* * * * *